US009377195B2

(12) United States Patent
Goodson et al.

(10) Patent No.: US 9,377,195 B2
(45) Date of Patent: Jun. 28, 2016

(54) INERTIAL ELECTRODE AND SYSTEM CONFIGURED FOR ELECTRODYNAMIC INTERACTION WITH A VOLTAGE-BIASED FLAME

(71) Applicant: ClearSign Combustion Corporation, Seattle, WA (US)

(72) Inventors: David B. Goodson, Bellevue, WA (US); Tracy A. Prevo, Seattle, WA (US); Joseph Colannino, Bellevue, WA (US); Robert E. Breidenthal, Seattle, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 653 days.

(21) Appl. No.: 13/731,223

(22) Filed: Dec. 31, 2012

(65) Prior Publication Data

US 2013/0230811 A1 Sep. 5, 2013

Related U.S. Application Data

(60) Provisional application No. 61/605,693, filed on Mar. 1, 2012.

(51) Int. Cl.

| | |
|---|---|
| ***F23L 7/00*** | (2006.01) |
| ***F23D 99/00*** | (2010.01) |
| ***F23C 99/00*** | (2006.01) |
| ***F23D 14/84*** | (2006.01) |

(52) U.S. Cl.

CPC ..... *F23L 7/00* (2013.01); *F23C 99/001* (2013.01); *F23D 14/84* (2013.01); *F23D 21/00* (2013.01)

(58) Field of Classification Search

USPC ..... 431/2, 4, 8, 253, 354

See application file for complete search history.

(56) References Cited

U.S. PATENT DOCUMENTS

| | | | | |
|---|---|---|---|---|
| 1,153,182 | A | 9/1915 | Schniewind | |
| 2,604,936 | A | 7/1952 | Kaehni et al. | |
| 3,087,472 | A | 4/1963 | Asakawa | |
| 3,224,485 | A | 12/1965 | Blomgren et al. | |
| 3,306,338 | A | 2/1967 | Wright et al. | |
| 3,358,731 | A | 12/1967 | Donnelly | |
| 3,416,870 | A * | 12/1968 | Wright | F23C 99/001 204/168 |
| 3,503,348 | A | 3/1970 | Dvirka | |
| 3,749,545 | A * | 7/1973 | Velkoff | F23C 99/001 123/537 |
| 3,841,824 | A | 10/1974 | Bethel | |

(Continued)

FOREIGN PATENT DOCUMENTS

| | | |
|---|---|---|
| WO | WO 96/01394 | 1/1996 |
| WO | WO 2012/109499 | 8/2012 |

OTHER PUBLICATIONS

F. Altendorfner et al., Electric Field Effects on Emissions and Flame Stability with Optimized Electric Field Geometry, The European Combustion Meeting ECM 2007, 2007, 1-6, Germany.

(Continued)

*Primary Examiner* — Avinash Savani

(74) *Attorney, Agent, or Firm* — Christopher A. Wiklof; Nicholas S. Bromer; Launchpad IP, Inc.

(57) ABSTRACT

A combustion system includes a subsystem for electrically biasing or charging a flame and a virtual electrode launcher configured to launch a virtual electrode in proximity to the flame or combustion gas produced by the flame.

64 Claims, 6 Drawing Sheets

(56) References Cited

U.S. PATENT DOCUMENTS

| | | | | |
|---|---|---|---|---|
| 3,869,362 | A | 3/1975 | Machi et al. | |
| 4,052,139 | A | 10/1977 | Paillaud et al. | |
| 4,091,779 | A | 5/1978 | Saufferer et al. | |
| 4,093,430 | A * | 6/1978 | Schwab | B03C 3/16 310/10 |
| 4,110,086 | A | 8/1978 | Schwab et al. | |
| 4,111,636 | A * | 9/1978 | Goldberg | F23C 99/001 431/2 |
| 4,118,202 | A | 10/1978 | Scholes | |
| 4,219,001 | A | 8/1980 | Kumagai et al. | |
| 4,238,184 | A * | 12/1980 | Schilling | F23N 5/123 340/579 |
| 4,260,394 | A | 4/1981 | Rich | |
| 4,304,096 | A | 12/1981 | Liu et al. | |
| 4,340,024 | A | 7/1982 | Suzuki et al. | |
| 4,439,980 | A | 4/1984 | Biblarz et al. | |
| 4,649,260 | A | 3/1987 | Melis et al. | |
| 4,675,029 | A | 6/1987 | Norman et al. | |
| 4,903,616 | A | 2/1990 | Mavroudis | |
| 4,987,839 | A | 1/1991 | Krigmont et al. | |
| 5,498,154 | A | 3/1996 | Velie et al. | |
| 5,702,244 | A | 12/1997 | Goodson et al. | |
| 5,741,711 | A * | 4/1998 | Amirav | G01N 30/68 422/54 |
| 6,640,549 | B1 | 11/2003 | Wilson et al. | |
| 6,736,133 | B2 | 5/2004 | Bachinski et al. | |
| 6,742,340 | B2 | 6/2004 | Nearhoof, Sr. et al. | |
| 6,918,755 | B1 | 7/2005 | Johnson et al. | |
| 7,137,808 | B2 * | 11/2006 | Branston | F23C 99/001 431/2 |
| 7,168,427 | B2 | 1/2007 | Bachinski et al. | |
| 7,182,805 | B2 | 2/2007 | Reaves | |
| 7,226,496 | B2 | 6/2007 | Ehlers | |
| 7,226,497 | B2 | 6/2007 | Ashworth | |
| 7,243,496 | B2 | 7/2007 | Pavlik et al. | |
| 7,377,114 | B1 | 5/2008 | Pearce | |
| 7,523,603 | B2 | 4/2009 | Hagen et al. | |
| 7,845,937 | B2 | 12/2010 | Hammer et al. | |
| 8,082,725 | B2 | 12/2011 | Younsi et al. | |
| 8,245,951 | B2 | 8/2012 | Fink et al. | |
| 8,851,882 | B2 | 10/2014 | Hartwick et al. | |
| 2005/0208442 | A1 | 9/2005 | Heiligers et al. | |
| 2006/0165555 | A1 | 7/2006 | Spielman et al. | |
| 2007/0020567 | A1 | 1/2007 | Branston et al. | |
| 2008/0145802 | A1 | 6/2008 | Hammer et al. | |
| 2010/0183424 | A1 | 7/2010 | Roy | |
| 2011/0072786 | A1 | 3/2011 | Tokuda et al. | |
| 2011/0203771 | A1 | 8/2011 | Goodson et al. | |
| 2012/0317985 | A1 | 12/2012 | Hartwick et al. | |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0230811 | A1 | 9/2013 | Goodson et al. | |
| 2013/0255482 | A1 | 10/2013 | Goodson | |
| 2013/0255548 | A1 | 10/2013 | Goodson et al. | |
| 2013/0255549 | A1 | 10/2013 | Sonnichsen et al. | |
| 2013/0260321 | A1 | 10/2013 | Colannino et al. | |
| 2014/0208758 | A1 | 7/2014 | Breidenthal et al. | |
| 2014/0338350 | A1 | 11/2014 | Breidenthal | |

OTHER PUBLICATIONS

Altendrfner et al., "Electric Field Effects on Emissions and Flame Stability with Optimized Electric Field Geometry", Third European Combustion Meeting ECM 2007, p. 1-6.

William T. Brande; "The Bakerian Lecture: On Some New Electro-Chemical Phenomena", Phil. Trans. R. Soc. Lond. 1814 104, p. 51-61.

James Lawton and Felix J. Weinberg. "Electrical Aspects of Combustion". Clarendon Press, Oxford. 1969.

* cited by examiner

INERTIAL ELECTRODE AND SYSTEM CONFIGURED FOR ELECTRODYNAMIC INTERACTION WITH A VOLTAGE-BIASED FLAME

CROSS REFERENCE TO RELATED APPLICATIONS

The present application claims priority benefit from U.S. Provisional Patent Application No. 61/605,693, entitled "INERTIAL ELECTRODE AND SYSTEM CONFIGURED FOR ELECTRODYNAMIC INTERACTION WITH A VOLTAGE-BIASED FLAME", filed Mar. 1, 2012; which, to the extent not inconsistent with the disclosure herein, is incorporated by reference.

SUMMARY

According to an embodiment, a burner system may include a burner configured to support a flame or a combustion gas stream produced by the flame and a flame charger configured to create a majority of charged particles having a first sign within at least a portion of the flame or the combustion gas stream produced by the flame to provide a charged. The embodiment may further include at least one inertial electrode launcher that may be configured to launch an inertial electrode in proximity to the flame or the combustion gas stream produced by the flame. The inertial electrode may include charged particles, may include particles selected to accept a charge, or may carry a voltage. The charged particles, charge accepting particles, or voltage may be selected to interact with the charged particles having the first sign carried by the flame or a combustion gas stream produced by the flame.

According to another embodiment, a method for operating a burner system may include supporting a flame with a burner and launching an inertial electrode in proximity to the flame or to a combustion gas produced by the flame. At least a portion of the flame or the combustion gas stream produced by the flame may be caused to carry a majority charge. The virtual electrode may include charged particles, particles selected to accept a charge, or a carried voltage. The particles or voltage may be selected to interact with the majority charge carried by the flame or the combustion gas stream produced by the flame.

DETAILED DESCRIPTION

Figure 1:
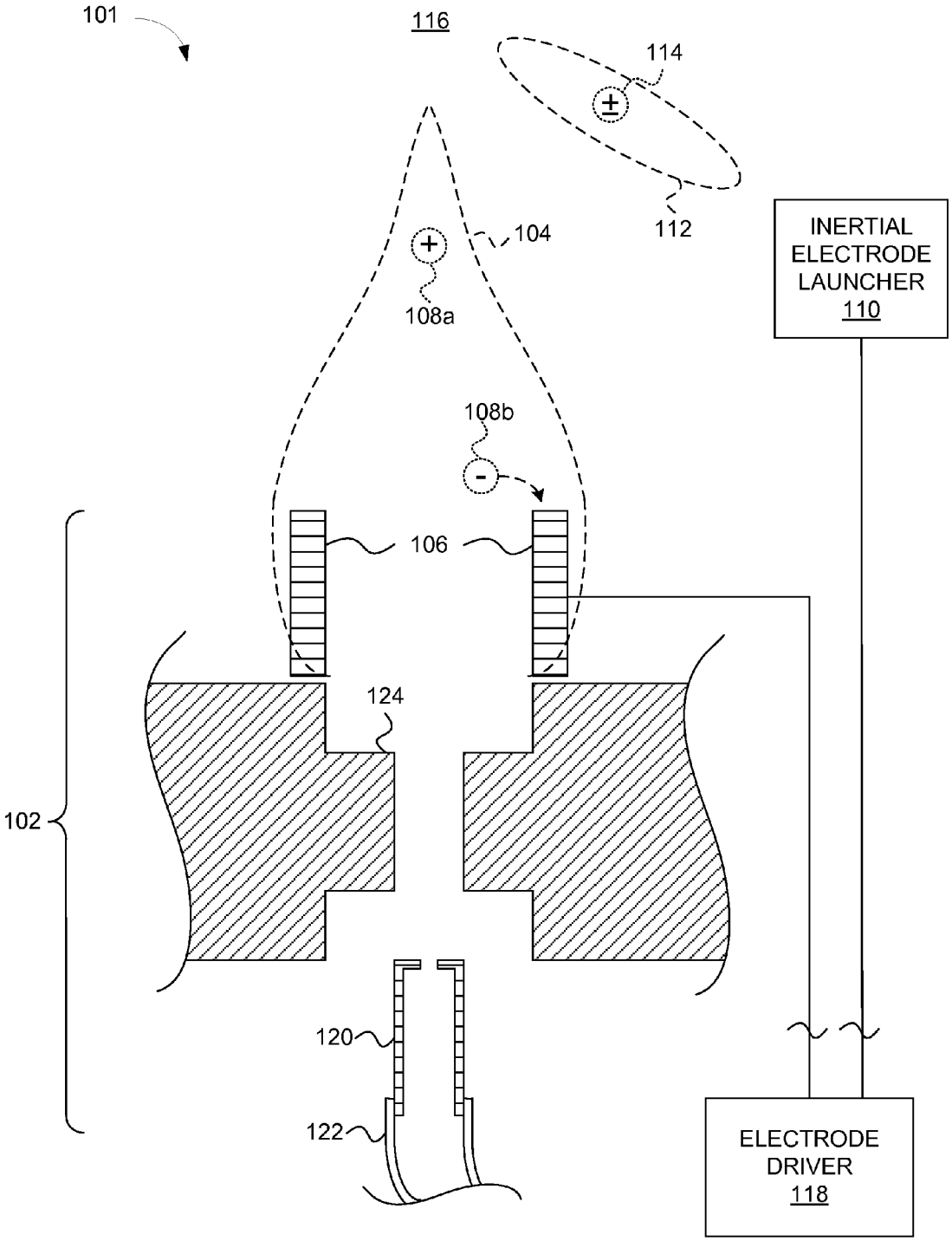
FIG. 1 is a diagram of a burner system supporting a flame and including a flame charger configured to provide a charged flame and at least one inertial electrode launcher configured to launch an inertial electrode in proximity to the charged flame, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 is a diagram of a burner system 101 including a burner 102 configured to support a flame 104, a flame charger 106 configured to apply a voltage or charge to the flame 104, and an inertial electrode launcher 110, according to an embodiment. The flame charger 106 may include a depletion electrode configured to at least intermittently or periodically attract charged particles having a second sign 108*b* to create at least a portion of the flame 104 having a majority of charged particles having a first sign 108*a*. Additionally or alternatively, the flame charger 106 may be configured to add charged particles having the first sign 108*a*. For example, the flame charger may include a corona electrode (not shown) configured to eject charged ions 108*a* toward the flame 104. In another example, the flame charger 106 may include an ionizer (not shown) configured to add charge to the flame 104, to a fuel (not shown) supporting the flame 104, or to air or other oxidizer (not shown) that supports the flame 104.

At least one inertial electrode launcher 110 may be configured to launch an inertial electrode 112 in proximity to the flame 104. The inertial electrode 112 may include charged particles 114 or particles 114 selected to accept a charge. Additionally or alternatively, the inertial electrode 112 may carry a voltage. The charged particles, charge accepting particles, or voltage may be selected to interact with the charged particles having the first sign 108*a* carried by the flame 104 or a combustion gas stream 116 produced by the flame 104. The flame charger 106 may be integrated with the burner 102, or may be separate from the burner 102. The inertial electrode 112 may include charged particles 114 that are selected to attract or selected to repel the charged particles having the first sign 108*a*.

The inertial electrode launcher 110 may be configured to impart momentum onto the inertial electrode 112. According to an embodiment, the launched inertial electrode may exhibit fluid dynamic properties that are momentum dominated. The charged particles having the first sign 108*a* carried by the flame 104 or the combustion gas stream 116 may be selected to respond to the momentum carried by the inertial electrode 112. According to an embodiment, a region of the flame having fluid dynamic properties that are buoyancy dominated may respond to the inertial electrode.

An electrode driver 118 may be configured to drive, i.e., to control and operate, one or more of the functions or operations performed by each of the flame charger 106 and of the inertial electrode launcher 110. The electrode driver 118 may be configured to periodically or intermittently change the first sign of the charged particles 108*a* carried by the flame 104 or the combustion gas stream 116. The electrode driver 118 may also be configured to periodically or intermittently change a sign of the charged particles 114 carried by the inertial electrode 112. In an embodiment using a flame charger 106 that is a depletion electrode, the electrode driver may be configured to periodically or intermittently change the second sign of charged particles 108*b* attracted by the depletion electrode 106. Changing the sign of the particles 108*b* attracted by the depletion electrode 106 may also change the first sign of the charged particles 108*a* carried by the flame 104 or the combustion gas stream 116. The first and second signs may be opposite of each other.

The burner 102 may include a fuel source 120 configured to provide fuel for the flame 104. An insulator or gap 122 may be configured to isolate the flame charger 106 from ground or another voltage. The burner 102 may also include a flame holder 124 configured to hold the flame.

Various inertial electrode launchers 110 and inertial electrodes 112 are contemplated. According to embodiments, an inertial electrode launcher 110 may be configured to launch the inertial electrode 112 through an aperture in an insulating refractory, such as a furnace, boiler, or burner body (not shown).

Figure 2:
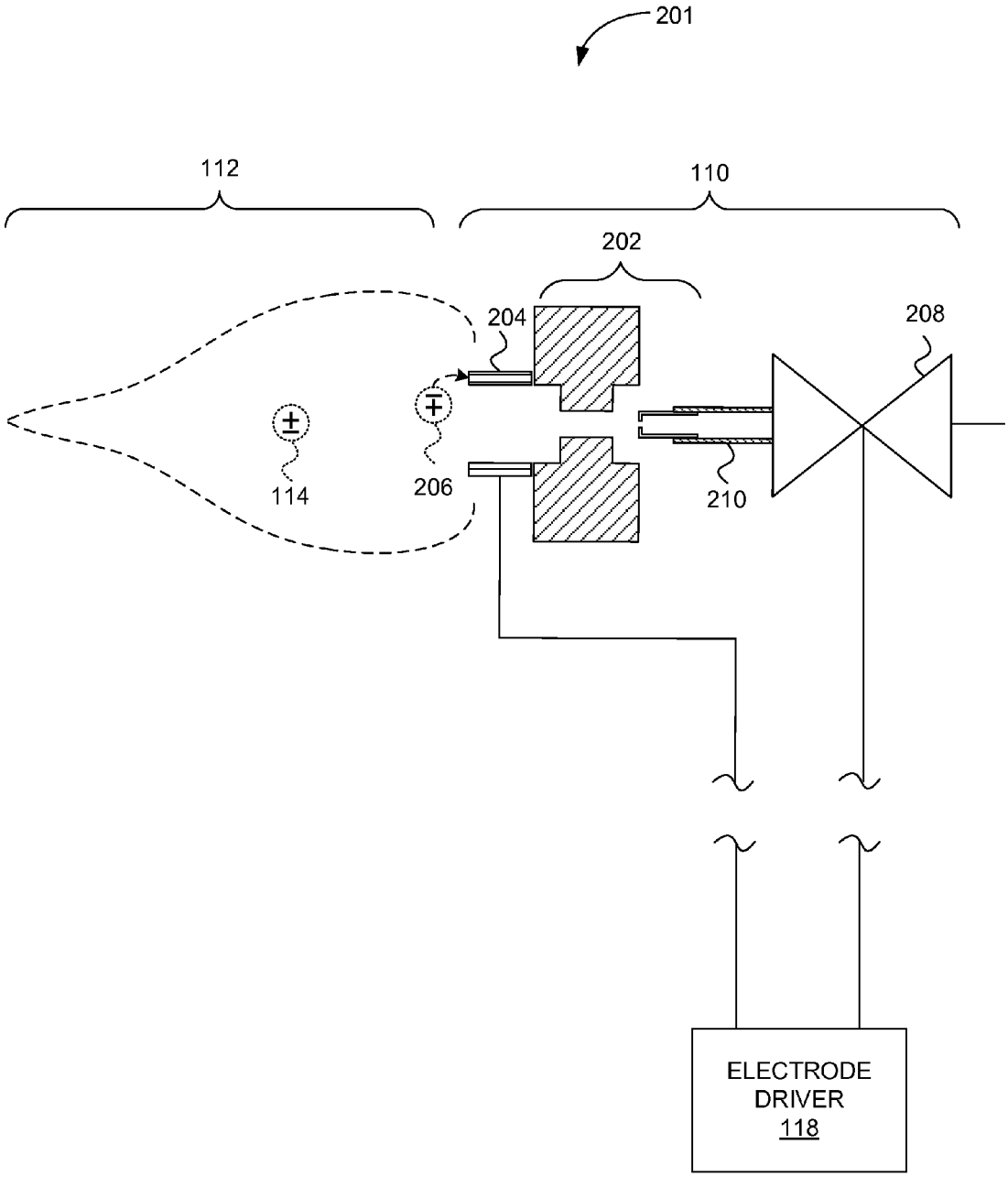
FIG. 2 is a diagram of an inertial electrode launcher including an inertial electrode burner configured to at least intermittently or periodically support a flame inertial electrode, according to an embodiment.

FIG. 2 illustrates an embodiment where the inertial electrode launcher 110 includes an inertial electrode burner 202. The inertial electrode burner 202 may be configured to at least intermittently or periodically support a flame inertial electrode 112. The inertial electrode launcher 110 may include an inertial electrode launcher charger 204, such as a depletion electrode 204 configured to attract from the flame inertial electrode 112 charges having a fourth sign 206 to create a majority of charged particles having a third sign 114 in the flame inertial electrode 112. The fourth sign of the charge carried by the charged particles 206 attracted from the flame inertial electrode 112 by the inertial electrode launcher depletion electrode 204 (to produce the majority of charged particles having the third sign 114 in the flame inertial electrode 112) may be the same as the second sign of the charge carried by the charged particles 108*b* attracted from the flame 104 by the depletion electrode 106 (to produce the majority of charged particles the first sign 108*a* in the flame 104). Accordingly, the first and third signs of the charges carried by the respective majority charged particles 108*a*, 114 in the flame 104 and the inertial electrode 112 may be the same.

The fourth sign of the charge carried by the charged particles 206 attracted from the flame inertial electrode 112 by the inertial electrode launcher depletion electrode 204 (to produce the majority of charged particles having the third sign 114 in the flame inertial electrode 112) may be opposite from the second sign of the charge carried by the charged particles 108*b* attracted from the flame 104 by the depletion electrode 106 (to produce the majority of charged particles the first sign 108*a* in the flame 104). Accordingly, the first and third signs of the charges carried by the respective majority charged particles 108*a*, 114 in the flame 104 and the inertial electrode 112 may be opposite from one another.

In alternative embodiments, the electrode launcher charger 204 may be configured to add charges 114 to the flame virtual electrode 112. For example, the electrode launcher charger 204 may include a corona electrode (not shown) configured to eject charged ions 114 toward the flame virtual electrode 112. In another example, the electrode launcher charger 204 may include an ionizer (not shown) configured to add charge 114 to the flame virtual electrode 112, to fuel (not shown) supporting the flame virtual electrode 112, or to air or other oxidizer (not shown) that supports the flame virtual electrode 112.

An electrode driver 118 may be configured to control at least one of the sign or concentration of the charged particles 114 in the flame inertial electrode 112.

The burner system 101 may include a valve 208 configured to control a flow of fuel (not shown) to the flame inertial electrode burner 202 and an electrode driver 118 configured to control the valve 208 and an igniter or pilot (not shown) configured to ignite the flame inertial electrode 112 when the valve 208 is opened. An electrical insulator or air gap 210 may be configured to electrically isolate the flame inertial electrode 112 from ground or another voltage.

According to the embodiment, the inertial electrode burner 202 may be arranged to be protected from a fluid flow past the burner 102. The arrangement may include positioning the inertial electrode burner 202 in the lee of a physical fluid flow barrier (not shown).

According to the embodiment, the flame inertial electrode 112 may be configured as a flame holder for the flame 104. Additionally the flame inertial electrode 112 may be configured to affect a shape or location of the flame 104 and may be configured to affect a concentration of the charged particles 108*a* in the flame 104.

Figure 3:
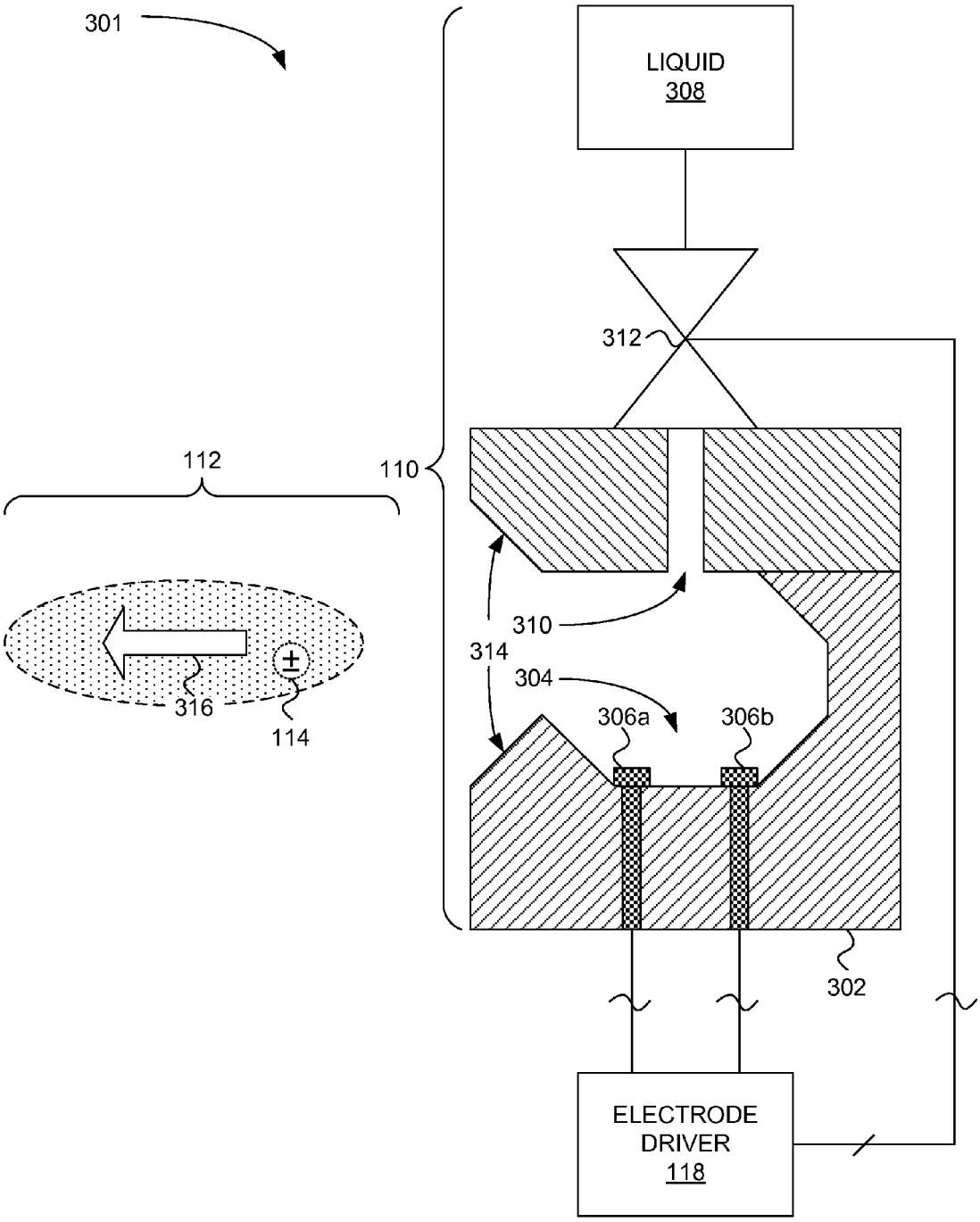
FIG. 3 is a diagram of an inertial electrode launcher configured to apply a voltage-biased potential to a vaporizing material to produce an inertial electrode including vapor, aerosol, or vapor and aerosol of the vaporizing material carrying charged particles, according to an embodiment.

FIG. 3 is a diagram showing an inertial electrode launcher 110 according to another embodiment. The inertial electrode launcher 110 may include a body 302 defining a vaporization well 304 and first and second electrodes 306*a*, 306*b* operatively coupled to an electrode driver 118. The electrode driver 118 may be configured to apply a high voltage to a vaporizing material 308 at least temporarily confined by the vaporization well 304. This may vaporize the vaporizing material 308 to produce an inertial electrode 112 including vapor, aerosol, or vapor and aerosol of the vaporizing material 308 carrying charged particles 114.

The electrode driver 118 may be configured to apply the high voltage with a voltage bias having a same sign as a sign of charge carried by a majority of the charged particles 114. Suddenly applying a voltage through the vaporizing material causes a rapid conversion from liquid to vapor, typically without a detectable increase in temperature. Vapor launched by the inertial electrode may condense to an aerosol during flight.

The burner system 101 may include a fluid flow passage 310 configured to admit the vaporizing material 308 to the vaporization well 304 and a valve or actuator 312 configured to enable a flow of the vaporizing material 308 through the fluid flow passage 310 to the vaporization well 304. The valve or actuator 312 may be operatively coupled to the electrode driver 118.

A nozzle 314 may be configured to determine a direction of travel 316 of the vapor, aerosol, or vapor and aerosol of the vaporizing material 308 forming the inertial electrode 112. An actuator (not shown) operatively coupled to the electrode driver 118 may be configured to align the nozzle 314 to an intended direction of travel 316 of the vapor, aerosol, or vapor and aerosol of the liquid 308 forming the inertial electrode 112.

The voltage bias and the charge sign of the majority charged particles 114 carried by the inertial electrode 112 is the same as the first sign of the charges carried by the majority charged particles 108*a* in the flame 104. Alternatively, the voltage bias and the charge sign of the majority charged particles 114 carried by the inertial electrode 112 may be the opposite of the first sign of the charges carried by the majority charged particles 108*a* in the flame 104.

The inertial electrode launcher 110 may be arranged to be protected from a fluid flow past the burner 102, such as by positioning the inertial electrode launcher 110 in the lee of a physical fluid flow barrier (not shown).

The inertial electrode 112 may be configured as a flame holder for the flame 104. Additionally or alternatively, the inertial electrode 112 may be driven to affect a shape or location of the flame 104 and/or may be driven to affect a concentration of the charged particles 108*a* in the flame 104 or the combustion gas stream 116.

The vaporizing material 308 may include a liquid such as water. The material 308 may additionally or alternatively include a dissolved solute and/or a molten salt. In some embodiments, the vaporizing material 308 may include, for example, a gel such as a hydrogel, gelatin and/or slurry. The slurry may include a liquid and an undissolved phase configured to be carried by the liquid when the liquid is vaporized. The undissolved phase may include carbon, for example. Additionally, the slurry may include a liquid and an undissolved phase selected to be vaporized by the voltage. A vaporizing undissolved phase may include a lithium salt, for example.

Figure 4:
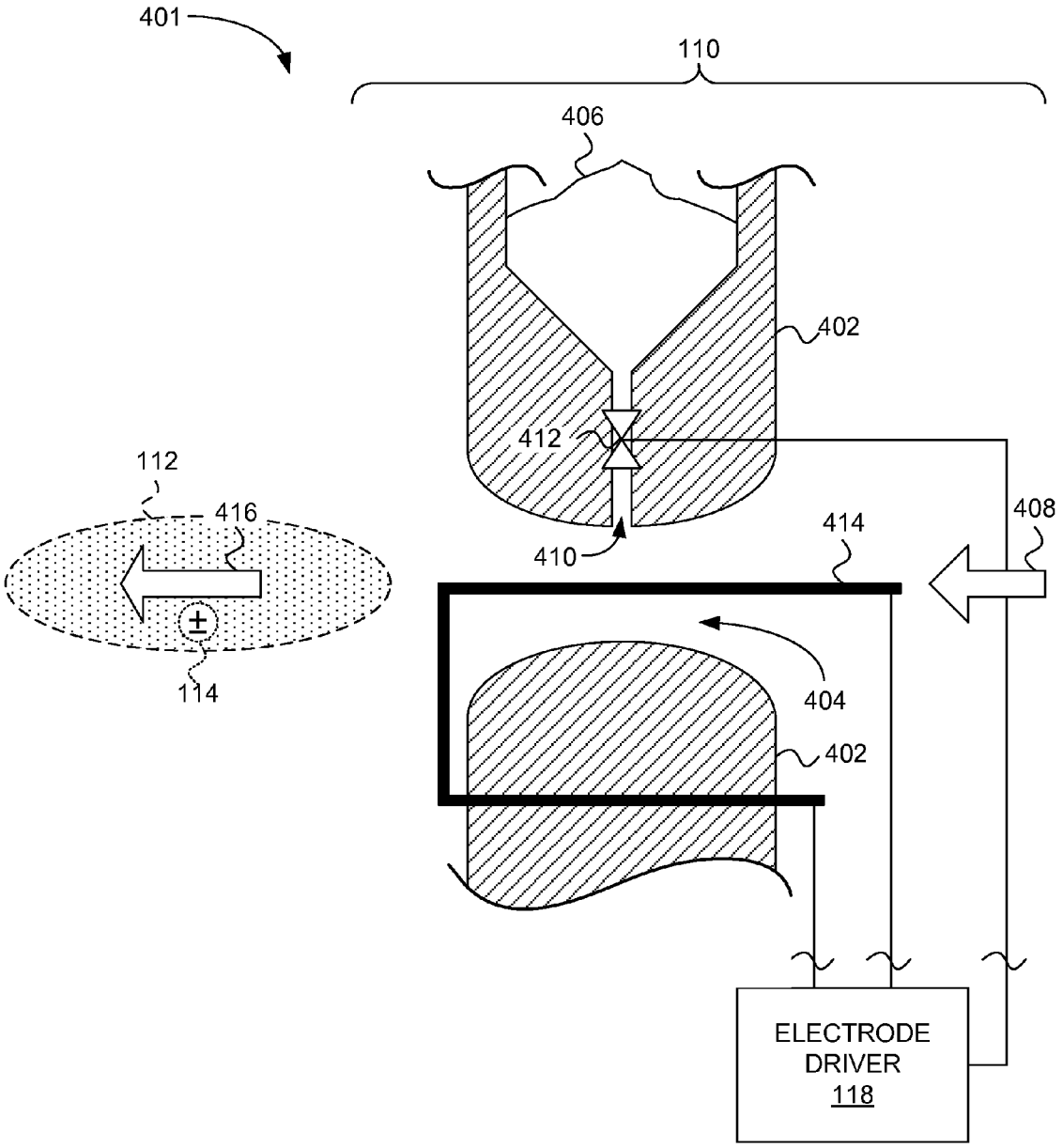
FIG. 4 is a diagram of an inertial electrode launcher configured to project charged or charge-accepting solid particles forming an inertial electrode to a location proximate the flame, according to an embodiment.

FIG. 4 illustrates an embodiment where the inertial electrode launcher 110 is configured to project an inertial electrode including charged solids. The inertial electrode launcher 110 may include a body 402 defining an orifice 404 from which solid particles 406 are projected to a location proximate the flame 104. The projected solid particles 406 may include at least one or more charged particles 114. The charged solid particles 406 may substantially form the inertial electrode 112.

The orifice 404 may include a Venturi passage. The solid particles 406 may be configured to be projected by an entrainment fluid 408 such as air passing through the orifice 404. The solid particles 406 may be injected into the passing entrainment fluid at the orifice 404 through a particle channel 410. A particle valve 412 may be operatively coupled to the electrode driver 118. The electrode driver 118 may be configured to control a rate of flow of particles through the particle channel 410 and/or a periodicity or intermittent timing of particle flow through the particle channel 410.

A corona surface 414 may be configured to be driven to sufficient voltage to cause an emission of charges. Some of the charges emitted by the corona may be deposited on at least some of the solid particles 406. The corona surface 414 may include a corona wire (not shown) and may include a corotron or scorotron (neither shown). The corona surface 414 may be operatively coupled to the electrode driver 118. The electrode driver 118 may be configured to control the voltage to which the corona surface 414 is driven.

The voltage sign to which the corona surface 414 is driven and the charge sign of the majority charged particles 114 carried by the inertial electrode 112 may be the same as the first sign of the charges carried by the majority charged particles 108*a* in the flame 104 or alternatively may be opposite of the first sign of the charges carried by the majority charged particles 108*a* in the flame 104.

The burner system 101 may further include an actuator (not shown) operatively coupled to the electrode driver 118 configured to align the orifice 404 to an intended direction of travel 416 of the charged solid particles 406 forming the inertial electrode 112.

The inertial electrode launcher 110 may be arranged to be protected from a fluid flow past the burner 102. This may include positioning the inertial electrode launcher 110 in the lee of a physical fluid flow barrier (not shown). The inertial electrode 112 may be configured as a flame holder for the flame 104. Additionally or alternatively, the inertial electrode 112 may be driven to affect a shape or location of the flame 104 and the inertial electrode 112 may be driven to affect a concentration of the charged particles 108*a* in the flame 104.

The solid particles 406 may include comminuted coal, coke, or carbon. The solid particles 406 may be selected to react in the flame 104 or the combustion gas stream 116 produced by the flame 104.

Figure 5:
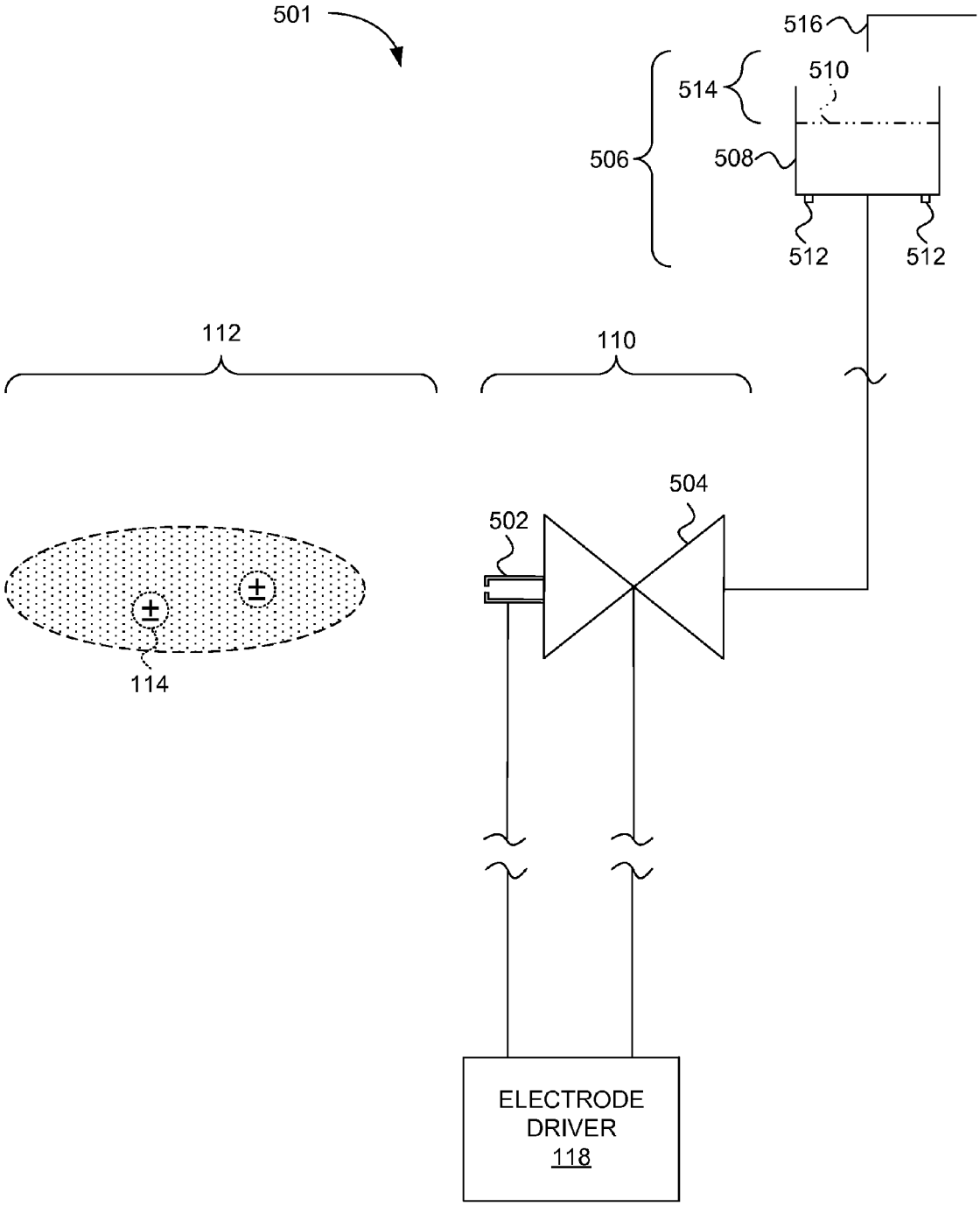
FIG. 5 is a diagram of an inertial electrode launcher configured to expel a fluid carrying charged particles or conducting a voltage, the fluid forming an inertial electrode, according to an embodiment.

FIG. 5 is a diagram showing an inertial electrode launcher 110 including a nozzle 502 configured to at least intermittently or periodically receive a voltage from the electrode driver 118 and expel a fluid carrying charged particles or a voltage corresponding to the voltage received from the electrode driver. The nozzle 502 may be configured to expel a fluid 510 carrying charged particles 114, wherein the charged particles 114 and fluid 510 may form the inertial electrode 112. Alternatively or additionally, the nozzle 502 may expel a conductive fluid selected to carry a voltage corresponding to the voltage placed on the nozzle 502. The fluid 510 may include a liquid such as water.

A valve 504 may be operatively coupled to the electrode driver 118 and may be configured to respond to an actuation signal from the electrode driver 118 to at least intermittently or periodically open flow of the fluid from a fluid supply system 506 to flow through the nozzle 502. The fluid supply system 506 may be configured to supply the fluid 510 to the nozzle 502 and maintain electrical isolation between the fluid 510 and a fluid source 516.

The fluid supply system 506 may further include a tank 508 to hold the fluid 510, the tank may be made of an electrically insulating material or may be supported by electrical insulators 512 to isolate the fluid 510 from ground or another voltage. An antisiphon arrangement 514 may be configured to maintain electrical isolation between the fluid 510 and the fluid source 516.

The voltage sign to which the nozzle 502 may be driven and the charge sign of the fluid charges 114 carried by the inertial electrode 112 may be the same as the first sign of the charges carried by the majority charged particles 108*a* in the flame 104 or in the combustion gas stream 116. Alternatively, the voltage sign to which the nozzle 502 may be driven and the charge sign of the fluid charges 114 carried by the inertial electrode 112 may be the opposite of the first sign of the charges carried by the majority charged particles 108*a* in the flame 104 or in the combustion gas stream 116.

The burner system 101 may further include an actuator (not shown) operatively coupled to the electrode driver 118 that may be configured to align the nozzle 502 to an intended direction of travel of the inertial electrode 112.

The nozzle 502 may be arranged to be protected from a fluid flow past the burner 102. The protection may include positioning the nozzle 502 in the lee of a physical fluid flow barrier (not shown). The inertial electrode 112 may be configured as a flame holder for the flame 104.

The inertial electrode 112 may be driven to affect a shape or location of the flame 104 or the combustion gas stream 116 and the inertial electrode 112 may be driven to affect a concentration of the charged particles 108*a* in the flame 104. Optionally, the fluid 510 may be selected to react in the flame 104 or the combustion gas stream 116 produced by the flame 104, or may carry particles selected to react.

The burner system 101 may further include an electrode driver 118 and a depletion electrode launcher (not shown) operatively coupled to the electrode driver 118. The depletion electrode 106 may be an inertial electrode 112.

The burner system 101 may further include a heated apparatus (not shown). The heated apparatus may include one or more of an electrical power generator, a turbine, a chemical process plant, a boiler, a water heater, a furnace, a land vehicle, a ship, or an aircraft configured to receive heat from the flame 104 or the combustion gas stream 116.

Figure 6:
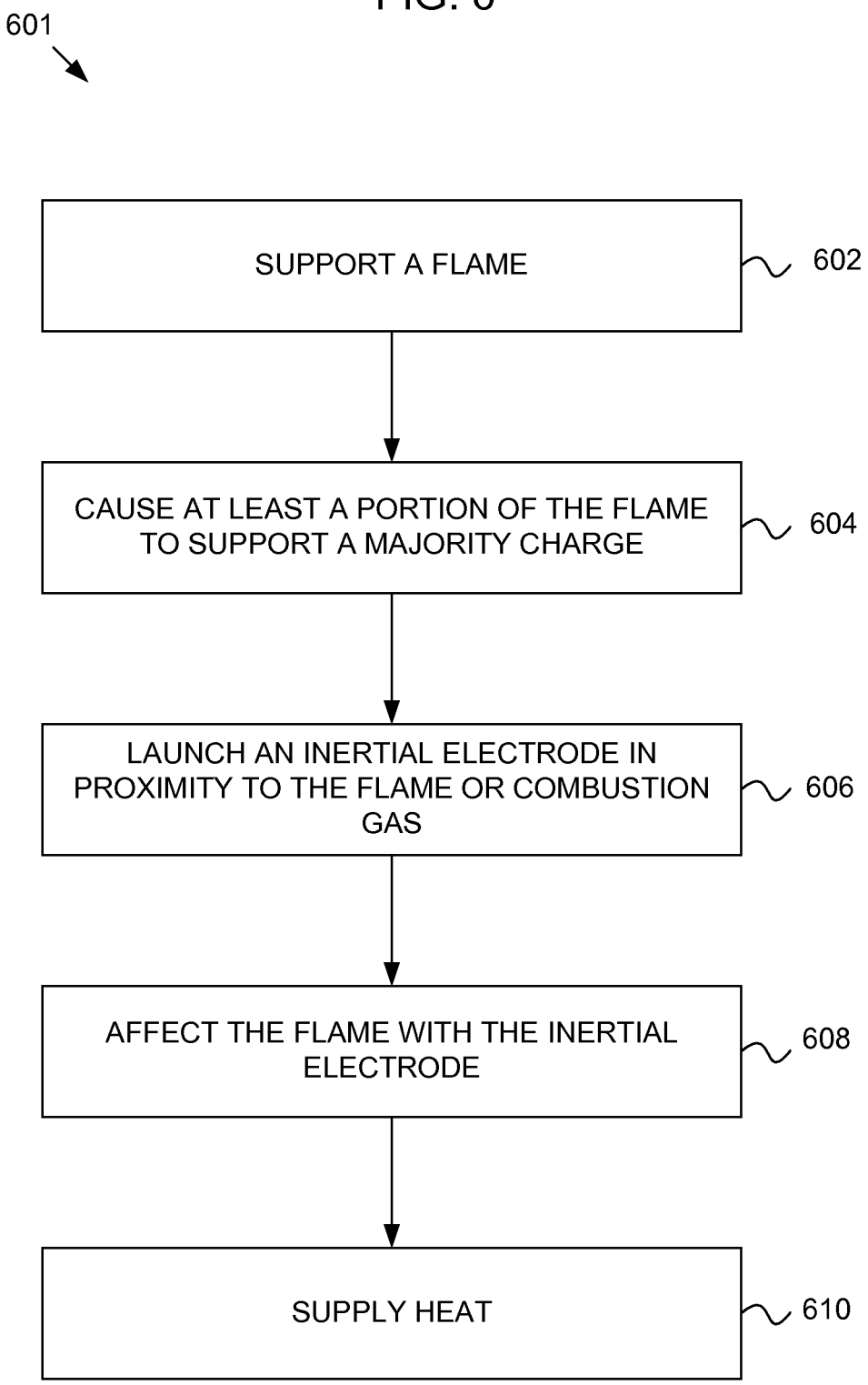
FIG. 6 is a flow chart showing a method for operating a burner system including an inertial electrode, according to an embodiment.

FIG. 6 is a flow chart illustrating a method 601 for operating a burner system including an inertial electrode, according to an embodiment. Beginning at step 602, a burner may support a flame. Proceeding to step 604, at least a portion of the flame or the combustion gas produced by the flame is caused to carry a majority charge having a first sign. Causing at least a portion of the flame or the combustion gas produced by the flame to carry the majority charge with the first sign may include attracting a charge opposite to the majority charge with a depletion electrode. In another embodiment, causing at least a portion of the flame or the combustion gas produced by the flame to carry the majority charge may include adding the majority charge to the flame or the combustion gas produced by the flame, such as with an ion-ejecting electrode or with an ionizer. Additionally or alternatively, causing at least a portion of the flame or the combustion gas produced by the flame to carry the majority charge may be performed by launching a flame charging inertial electrode in proximity to the flame or the combustion gas produced by the flame. For example, the majority charge carried by the flame or the combustion gas produced by the flame may correspond to a majority charge carried by the flame charging inertial electrode.

Proceeding to step 606, an inertial electrode is launched in proximity to the flame or to the combustion gas produced by the flame. Step 606 may include causing the inertial electrode to carry majority charges having a second sign. According to an embodiment, the sign of the majority charges carried by the inertial electrode may be the same as the first sign of the majority charges carried by at least a portion of the flame or the combustion gas produced by the flame (e.g., to cause the inertial electrode to repel the flame). Alternatively, the sign of the majority charges carried by the inertial electrode may be opposite of the first sign of the majority charges carried by the flame or the combustion gas produced by the flame (e.g., to cause the inertial electrode to attract the flame).

Proceeding to step 608, a shape, location, or other attribute of the flame may be affected with the inertial electrode. For example, the inertial electrode may, in step 608, affect a concentration of the charged particles in the flame or the combustion gas produced by the flame. Alternatively or additionally, at least a portion of the inertial electrode may react with the flame or the combustion gas produced by the flame. Additionally or alternatively, a flame may be flattened, lengthened, caused to flow toward or away from an inertial electrode, caused to emit more or less radiation, caused to combust to a greater degree of completion, cooled, caused to react more rapidly, or otherwise modified by the inertial electrode.

According to an embodiment, the method 601 may include protecting an inertial electrode launcher from exposure to a fluid flow past the flame (not shown). For example, protecting the inertial electrode launcher from exposure to the fluid flow past the flame may include positioning the inertial flame holder and/or at least a portion of the inertial electrode in the lee of a physical fluid flow barrier (not shown). In such a case, step 608 may include providing flame holding with the inertial electrode Proceeding to step 610, heat from the flame or the combustion gas produced by the flame may be supplied to an apparatus, system, or process. For example, step 610 may include supplying heat from the flame or the combustion gas produced by the flame to an electrical power generator, a turbine, a chemical process plant, a boiler, a water heater, a furnace, a land vehicle, a ship, or an aircraft.

Referring again to step 606, various forms of inertial electrodes are contemplated. Some embodiments are described above in conjunction with FIGS. 1-5. For example, step 606 may include launching a second flame comprising the inertial electrode. The second flame may be caused to carry an inertial electrode majority charge.

Alternatively, launching the inertial electrode in step 606 may include vaporizing a liquid carrying an inertial electrode majority charge and projecting the vaporized liquid or an aerosol of the liquid in proximity to the flame or the combustion gas produced by the flame. Vaporizing the liquid carrying the inertial electrode majority charge may include applying a biased voltage through the liquid between electrodes.

According to another embodiment, launching the inertial electrode in step 606 may include propelling solid particles carrying an inertial electrode majority charge. For example, propelling solid particles carrying an inertial electrode majority charge may include entraining the solid particles in a fluid stream and depositing the inertial electrode majority charge on the entrained solid particles. The solid particles may include at least one of comminuted coal, coke, or carbon.

According to another embodiment, launching the inertial electrode in step 606 may include energizing a nozzle with an inertial electrode voltage and projecting a liquid from the nozzle. For example, the liquid may include water.

Optionally, the method 601 may include actuating a direction of launch of the inertial electrode (not shown). Optionally, the method 601 may include actuating a timing, volume, or charge concentration of the inertial electrode (not shown).

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A burner system, comprising:

a burner configured to support a flame;

a first depletion electrode configured to at least intermittently contact the flame or a combustion gas stream produced by the flame and configured to at least intermittently or periodically attract charged particles having a second sign to create at least a portion of the flame or the combustion gas stream produced by the flame having a majority of charged particles having a first sign; and at least one inertial electrode launcher configured to launch an inertial electrode in proximity to the flame or the combustion gas stream produced by the flame, the inertial electrode including charged particles, including particles selected to accept a charge, or carrying a voltage, the charged particles, charge accepting particles, or voltage being selected to interact with the charged particles having the first sign carried by the flame or the combustion gas stream produced by the flame, wherein the inertial electrode includes non-fuel charged particles.

2. The burner system of claim 1, wherein the first depletion electrode is integrated with the burner.

3. The burner system of claim 1, wherein the first depletion electrode is separate from the burner.

4. The burner system of claim 1, wherein the inertial electrode includes charged particles selected to attract the charged particles having the first sign.

5. The burner system of claim 1, wherein the inertial electrode includes charged particles selected to repel the charged particles having the first sign.

6. The burner system of claim 1, wherein the inertial electrode launcher is configured to impart momentum onto the inertial electrode; and wherein the charged particles having the first sign carried by the flame or the combustion gas stream are selected to respond to the momentum carried by the inertial electrode.

7. The burner system of claim 1, further comprising:

an electrode driver configured to control and operate one or more function or operation performed by each of the first depletion electrode and the inertial electrode launcher.

8. The burner system of claim 7, wherein the electrode driver is configured to periodically or intermittently change the second sign of the charged particles attracted by the first depletion electrode and the first sign of the charged particles carried by the flame or the combustion gas stream.

9. The burner system of claim 7, wherein the electrode driver is configured to periodically or intermittently change a sign of the charged particles carried by the inertial electrode.

10. The burner system of claim 1, wherein the first and second signs are opposite of each other.

11. The burner system of claim 7, wherein the inertial electrode launcher comprises:

an inertial electrode burner configured to at least intermittently or periodically support a flame inertial electrode; and a second depletion electrode configured to attract from the flame inertial electrode charges having a fourth sign to create a majority of charged particles having a third sign in the flame inertial electrode.

12. The burner system of claim 11, wherein:

the electrode driver is further configured to control at least one of the sign or a concentration of the charged particles in the flame inertial electrode.

13. The burner system of claim 11, further comprising:

a valve configured to control a flow of fuel to the flame inertial electrode burner;

wherein the electrode driver is further configured to control the valve.

14. The burner system of claim 13, further comprising:

an igniter or pilot configured to ignite the flame inertial electrode when the valve is opened.

15. The burner system of claim 11, further comprising:

an electrical insulator or air gap configured to electrically isolate the flame inertial electrode from ground or from another voltage.

16. A burner system, comprising:

a burner configured to support a flame;

a first depletion electrode configured to at least intermittently contact the flame or a combustion gas stream produced by the flame and configured to at least intermittently or periodically attract charged particles having a second sign to create at least a portion of the flame or the combustion gas stream produced by the flame having a majority of charged particles having a first sign;

at least one inertial electrode launcher configured to launch an inertial electrode in proximity to the flame or the combustion gas stream produced by the flame, the inertial electrode including charged particles, including particles selected to accept a charge, or carrying a voltage, the charged particles, charge accepting particles, or voltage being selected to interact with the charged particles having the first sign carried by the flame or the combustion gas stream produced by the flame; and an electrode driver configured to control and operate one or more function or operation performed by each of the first depletion electrode and the inertial electrode launcher;

wherein the inertial electrode launcher further comprises:

a body defining a vaporization well; and a first and second electrodes, operatively coupled to an electrode driver configured to apply a high voltage to a vaporizing material at least temporarily confined by the vaporization well to vaporize the vaporizing material and to produce an inertial electrode including vapor, aerosol, or vapor and aerosol of the vaporizing material carrying charged particles;

wherein the electrode driver is further configured to apply the high voltage with a voltage bias having a same sign as a sign of charge carried by a majority of the charged particles.

17. The burner system of claim 16, further comprising:

a fluid flow passage configured to admit the vaporizing material into the vaporization well.

18. The burner system of claim 17, further comprising:

a valve or actuator configured to enable a flow of the vaporizing material through the fluid flow passage into the vaporization well.

19. The burner system of claim 18, wherein the valve or actuator is operatively coupled to the electrode driver.

20. The burner system of claim 16, further comprising:

a nozzle configured to determine a direction of travel of the vapor, aerosol, or vapor and aerosol of the vaporizing material forming the inertial electrode.

21. The burner system of claim 20, further comprising:

an actuator operatively coupled to the electrode driver configured to align the nozzle to an intended direction of travel of the vapor, aerosol, or vapor and aerosol of the liquid forming the inertial electrode.

22. The burner system of claim 16, wherein the vaporizing material includes a liquid.

23. The burner system of claim 22, wherein the liquid includes a dissolved solute.

24. The burner system of claim 16, wherein the vaporizing material includes a gel.

25. The burner system of claim 16, wherein the vaporizing material includes a slurry.

26. The burner system of claim 25, wherein the slurry includes a liquid and an undissolved phase configured to be carried by the liquid when the liquid is vaporized.

27. The burner system of claim 26, wherein the undissolved phase includes carbon.

28. The burner system of claim 7, wherein the inertial electrode launcher comprises:

a body defining an orifice from which solid particles are projected to a location proximate the flame or the combustion gas produced by the flame;

wherein at least some of the projected solid particles include charged solid particles; and wherein one or more of the charged solid particles form the inertial electrode.

29. The burner system of claim 28, wherein the orifice includes a Venturi passage.

30. The burner system of claim 28, wherein the solid particles are configured to be projected by an entrainment fluid passing through the orifice.

31. The burner system of claim 28, wherein the solid particles are injected into a passing entrainment fluid at the orifice through a particle channel.

32. The burner system of claim 31, further comprising:

a particle valve operatively coupled to the electrode driver;

wherein the electrode driver is further configured to control at least one of a rate of flow of the solid particles through the particle channel or a periodic or intermittent particle flow through the particle channel.

33. The burner system of claim 28, further comprising:
a corona surface configured to be driven to a sufficient voltage to cause an emission of charges;
wherein at least some of the charges emitted by the corona surface are deposited on at least some of the solid particles.

34. The burner system of claim 33, wherein the corona surface is operatively coupled to the electrode driver and the electrode driver is configured to control the voltage to which the corona surface is driven.

35. The burner system of claim 28, further comprising:
an actuator operatively coupled to the electrode driver configured to align the orifice to an intended direction of travel of the charged solid particles forming the inertial electrode.

36. The burner system of claim 28, wherein the solid particles include comminuted coal, coke, or carbon.

37. The burner system of claim 28, wherein the solid particles are selected to react in the flame or with combustion gas produced by the flame.

38. The burner system of claim 7, wherein the inertial electrode launcher further comprises:
a nozzle configured to at least intermittently or periodically receive a voltage with a voltage bias having a charge sign from the electrode driver and configured to expel a fluid carrying charged particles;
wherein the fluid carrying the charged particles forms the inertial electrode.

39. The burner system of claim 38, wherein the fluid includes a liquid.

40. The burner system of claim 38, further comprising:
a valve operatively coupled to the electrode driver and configured to respond to an actuation signal from the electrode driver to at least intermittently or periodically open a flow of the fluid from a fluid supply system to flow through the nozzle.

41. The burner system of claim 38, further comprising:
a fluid supply system configured to supply the fluid to the nozzle and maintain electrical isolation between the fluid and a fluid source.

42. The burner system of claim 41, wherein the fluid supply system further comprises:
a tank to hold the fluid, the tank being made of an electrically insulating material or being supported by electrical insulators to isolate the fluid from ground or from another voltage; and
an antisiphon arrangement configured to maintain electrical isolation between the fluid and the fluid source.

43. The burner system of claim 38, further comprising:
an actuator operatively coupled to the electrode driver configured to align the nozzle to an intended direction of travel of the inertial electrode.

44. The burner system of claim 38, wherein the fluid is selected to react in the flame or with the combustion gas produced by the flame.

45. The burner system of claim 1, further comprising:
a heated apparatus.

46. A method for operating a burner system, comprising:
supporting a flame with the burner of claim 1; and
launching an inertial electrode in proximity to the flame or a combustion gas produced by the flame;
wherein launching the inertial electrode further comprises:
vaporizing a liquid carrying an inertial electrode majority charge; and
projecting the vaporized liquid or an aerosol of the liquid in proximity to the flame or the combustion gas produced by the flame.

47. The method of claim 46, further comprising:
causing at least a portion of the flame or the combustion gas produced by the flame to carry a majority charge.

48. The method of claim 47, wherein causing at least a portion of the flame or the combustion gas produced by the flame to carry the majority charge includes attracting a charge opposite to the majority charge with a first depletion electrode.

49. The method of claim 47, wherein causing at least a portion of the flame or the combustion gas produced by the flame to carry the majority charge is performed by launching the inertial electrode in proximity to the flame or the combustion gas produced by the flame.

50. The method of claim 49, wherein the majority charge corresponds to the majority charge carried by the inertial electrode.

51. The method of claim 46, wherein launching the inertial electrode in proximity to the flame or the combustion gas produced by the flame further comprises:
causing the inertial electrode to carry a majority charge having a sign.

52. The method of claim 47, further comprising:
causing at least a portion of the flame or the combustion gas produced by the flame to carry the majority charge having a first sign;
wherein the sign of the majority charge carried by the inertial electrode is the same as the first sign.

53. The method of claim 47, further comprising:
causing at least a portion of the flame or the combustion gas produced by the flame to carry the majority charge having a first sign;
wherein the sign of the majority charge carried by the inertial electrode is opposite of the first sign.

54. The method of claim 46, further comprising:
reacting at least a portion of the inertial electrode with the flame or the combustion gas produced by the flame.

55. The method of claim 46, wherein launching the inertial electrode further comprises:
launching a second flame comprising the inertial electrode in proximity to the flame or the combustion gas produced by the flame.

56. The method of claim 55, further comprising:
causing the second flame to carry the inertial electrode majority charge.

57. The method of claim 46, wherein vaporizing the liquid carrying the inertial electrode majority charge includes applying a biased voltage through the liquid between electrodes.

58. The method of claim 46, wherein launching the inertial electrode further comprises:
propelling solid particles carrying the inertial electrode majority charge.

59. The method of claim 58, wherein propelling solid particles carrying the inertial electrode majority charge further comprises:
entraining the solid particles in a fluid stream; and
depositing the inertial electrode majority charge on at least some of the entrained solid particles.

60. The method of claim 58, wherein the solid particles include at least one of comminuted coal, coke, or carbon.

61. The method of claim 46, wherein launching the inertial electrode further comprises:
energizing a nozzle with an inertial electrode voltage; and
projecting a liquid from the nozzle.

62. The method of claim 46, further comprising:
actuating a direction of launch of the inertial electrode.

63. The method of claim 46, further comprising:

actuating a timing, volume, or charge concentration of the inertial electrode.

64. The method of claim 46, further comprising:

supplying heat from the flame or the combustion gas produced by the flame to an electrical power generator, a turbine, a chemical process plant, a boiler, a water heater, a furnace, a land vehicle, a ship, or an aircraft.

* * * * *